US005699771A

United States Patent [19]

Tanabe

[11] Patent Number: 5,699,771

[45] Date of Patent: Dec. 23, 1997

[54] FUEL CONTROLLER FOR INTERNAL COMBUSTION ENGINE

[75] Inventor: Tsuneo Tanabe, Tokyo, Japan

[73] Assignee: Mitsubishi Denki Kabushiki Kaisha, Tokyo, Japan

[21] Appl. No.: 677,528

[22] Filed: Jul. 10, 1996

[30] Foreign Application Priority Data

Feb. 19, 1996 [JP] Japan ..... 8-030789

[51] Int. Cl.[6] ..... F02D 41/22

[52] U.S. Cl. ..... 123/479; 73/118.1; 123/414

[58] Field of Search ..... 123/414, 479; 73/117.3, 118.1

[56] References Cited

U.S. PATENT DOCUMENTS 4,825,691 5/1989 Sekiguchi ..... 123/479 X 5,269,274 12/1993 Flaetgen et al. ..... 123/414

5,469,823 11/1995 Ott et al. ..... 123/414

FOREIGN PATENT DOCUMENTS 4243177 6/1994 Germany ..... 123/414

1-232151 9/1989 Japan .

*Primary Examiner*—Tony M. Argenbright

*Attorney, Agent, or Firm*—Sughrue, Mion, Zinn, Macpeak & Seas, PLLC

[57] ABSTRACT

A fuel controller for an internal combustion engine includes a rotational speed sensor 4 for detecting a rotational speed of a cam shaft of the engine 1, a crank angle sensor 5 for detecting a rotational speed of a crank shaft of the engine 1, and a controller 7 for determining whether the crank angle sensor 5 is normally operated or not based on an output from the rotational speed sensor 4 and an output from the crank angle sensor 5. With this arrangement, the fuel controller can securely execute fuel control with high reliability by detecting the failure of various sensors relating to the fuel control.

5 Claims, 4 Drawing Sheets

FUEL CONTROLLER FOR INTERNAL COMBUSTION ENGINE

BACKGROUND OF THE INVENTION

1. Field of the Invention

The present invention relates to a fuel controller for an internal combustion engine, and more specifically, to a fuel controller for an internal combustion engine capable of securely executing fuel control by detecting the failure of various sensors relating to the fuel control.

2. Description of the Related Art

Usually, when a fuel controller for an internal combustion engine executes fuel control such as fuel injection control, ignition timing and energization control, control for the number of idle rotations and the like in an internal combustion engine, the fuel controller executes the control making use of an output from a rotational speed sensor for detecting a rotational speed of a cam shaft of the internal combustion engine. Recently, however, it is required to precisely detect a rotational variation of the engine to detect misfire and execute high level control in the internal combustion engine.

To satisfy this requirement, there is generally provided a crank angle sensor for detecting a rotational speed of a crank shaft of the internal combustion engine so as to precisely detect the rotational variation of the internal combustion engine based on an output from the crank angle sensor.

However, a problem arises in the conventional fuel controller for an internal combustion engine in that if the controller executes control based on an output from the crank angle sensor, regardless of the fact that a precise rotational variation cannot be detected, as when a failure such as breaking of wire or the like is caused to the crank angle sensor or the crank angle sensor makes an erroneous output, the detection of misfire is erroneously determined and the internal combustion engine malfunctions.

Further, when failure such as breaking of wire or the like is caused to the rotational speed sensor, there is a problem that the failure such as breaking of wire or the like of a cylinder discrimination sensor for discriminating cylinders of the internal combustion engine, which is usually detected based on an output from the rotational speed sensor, cannot be detected.

An object of the present invention made to solve the above problems is to provide a highly reliable fuel controller for internal combustion engine capable of securely executing fuel control by detecting the failure of various sensors even if they fail.

SUMMARY OF THE INVENTION

According to one aspect of the present invention, there is provided a fuel controller for an internal combustion engine which comprises a first sensor for detecting a rotational speed of a cam shaft of an internal combustion engine, a second sensor for detecting a rotational speed of a crank shaft of the internal combustion engine and a determination means connected to the first and second sensors for determining whether the second sensor is normally operated or not based on an output from the first sensor and an output from the second sensor.

In one form of the invention, the determination means includes a plurality of counters for counting output pulses output from the first and second sensors, and determines whether the second sensor is normally operated or not based on count values counted by the counters.

According to another aspect of the present invention, there is provided a fuel controller for an internal combustion engine which comprises a first sensor for detecting a rotational speed of a cam shaft of an internal combustion engine, a second sensor for detecting a rotational speed of a crank shaft of the internal combustion engine, a third sensor for discriminating cylinders of the internal combustion engine, and determination means connected to the first to third sensors for determining whether the third sensor is normally operated or not based on an output from the second sensor when the first sensor fails.

In one form of the invention, the determination means includes a plurality of counters for counting output pulses output from the first, second and third sensors and determines whether the third sensor is normally operated or not based on count values counted by the counters.

In another form of the invention, when the first sensor fails, fuel is controlled based on an output from the second sensor.

DESCRIPTION OF PREFERRED EMBODIMENTS

Figure 1:
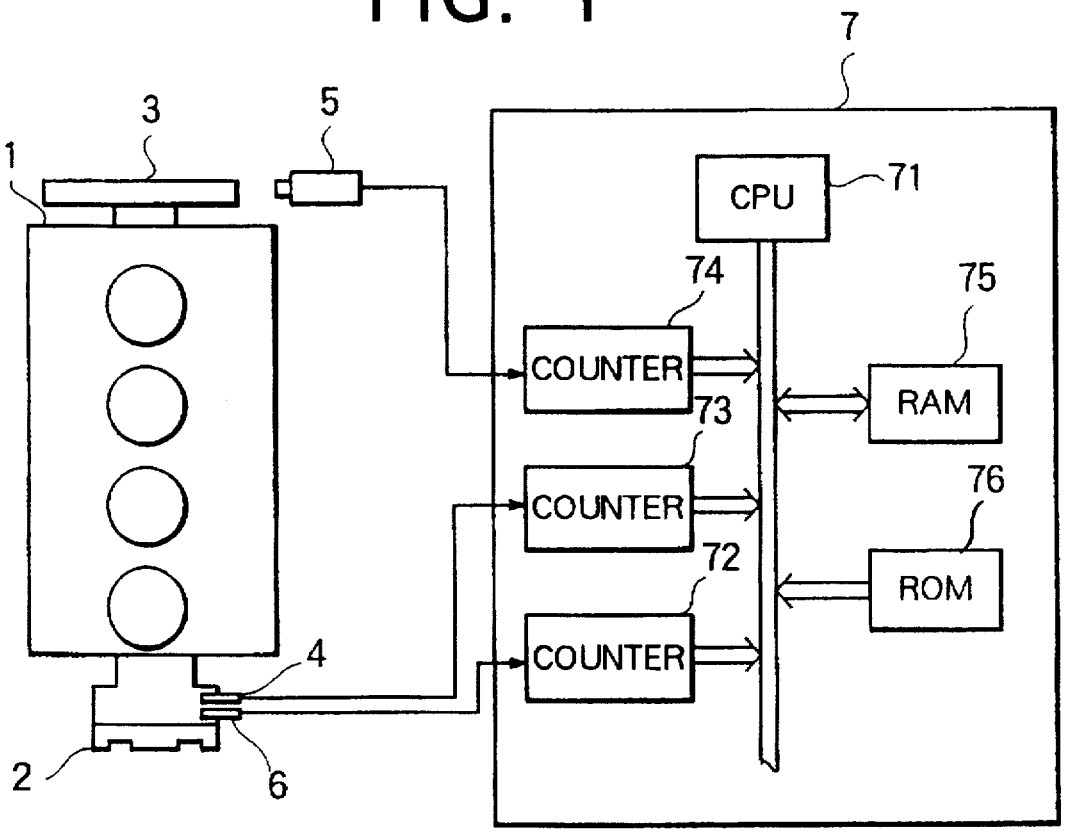
FIG. 1 is a block diagram showing an arrangement of a first embodiment of a fuel controller for an internal combustion engine according to the present invention.

In FIG. 1 the drawing, an internal combustion engine 1 includes a distributor 2 and a flywheel or crank pulley 3 disposed at the extreme end of a crank shaft (not shown) for converting the reciprocating movement of pistons into rotational movement and taking out power therefrom. The distributor 2 is an ignition timing controller for orderly distributing a high tension voltage generated at ignition coils to respective cylinders by generating an ignition signal in synchronism with the stroke of the internal combustion engine and controlling the ignition signal. A power transmission belt (not shown) is trained around the outer periphery of the crank pulley 3 to drive auxiliary equipment such as a generator of the engine, and the like.

A rotational speed sensor 4 as a first sensor is disposed at the distributor 2 to detect a rotational speed of a cam shaft (not shown) of the internal combustion engine 1, and a crank angle sensor 5 as a second sensor is disposed in the vicinity of the crank pulley 3 to detect a rotational speed of the crank shaft of the internal combustion engine by being magnetically coupled with the rotational angle sensor 4.

A cylinder discrimination sensor 6 as a third sensor is disposed at the distributor 2 to discriminate cylinders of the internal combustion engine 1.

Further, there is provided a controller 7 as a determination means for controlling fuel to be supplied to the internal combustion engine 1. The controller 7 includes a CPU 71, counters 72–74 connected to the CPU 71 through a bus, a RAM 75 and a ROM 76.

Figure 2:
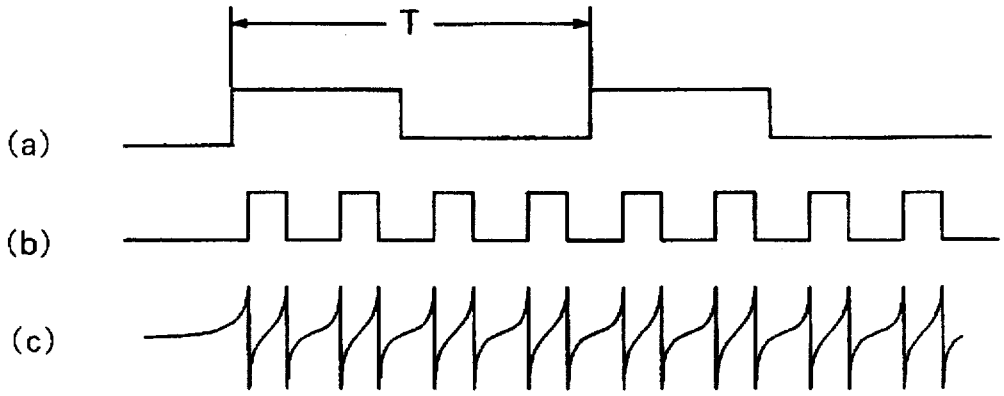
FIG. 2 is a waveform diagram explaining operation of respective embodiments of the fuel controller according to the present invention.

The counter 72 is connected to the cylinder discrimination sensor 6 and counts output signals output from the cylinder discrimination sensor 6 as shown in FIG. 2 at (*a*). The counter 73 is connected to the rotational speed sensor 4 and counts output signals output from the rotational speed sensor 4 as shown in FIG. 2 at (*b*). Further, the counter 74 is connected to the crank angle sensor 5 and counts output signals output from the crank angle sensor 5 as shown in FIG. 2 at (*c*).

In FIG. 2, a symbol T denotes a period during which a single cylinder is discriminated (corresponding to one cycle of the engine). The internal combustion engine 1 rotates once in two cycles (corresponding to two pulses) of the output signal from the rotational speed sensor 4, or once in four cycles (corresponding to four pulses) of the output signal from the crank angle sensor 5.

The RAM 75 is a random access memory for storing information when the CPU 71 executes an arithmetic operation and the ROM 76 is a read only memory for prestoring a program and the like to be described later.

Figure 3:
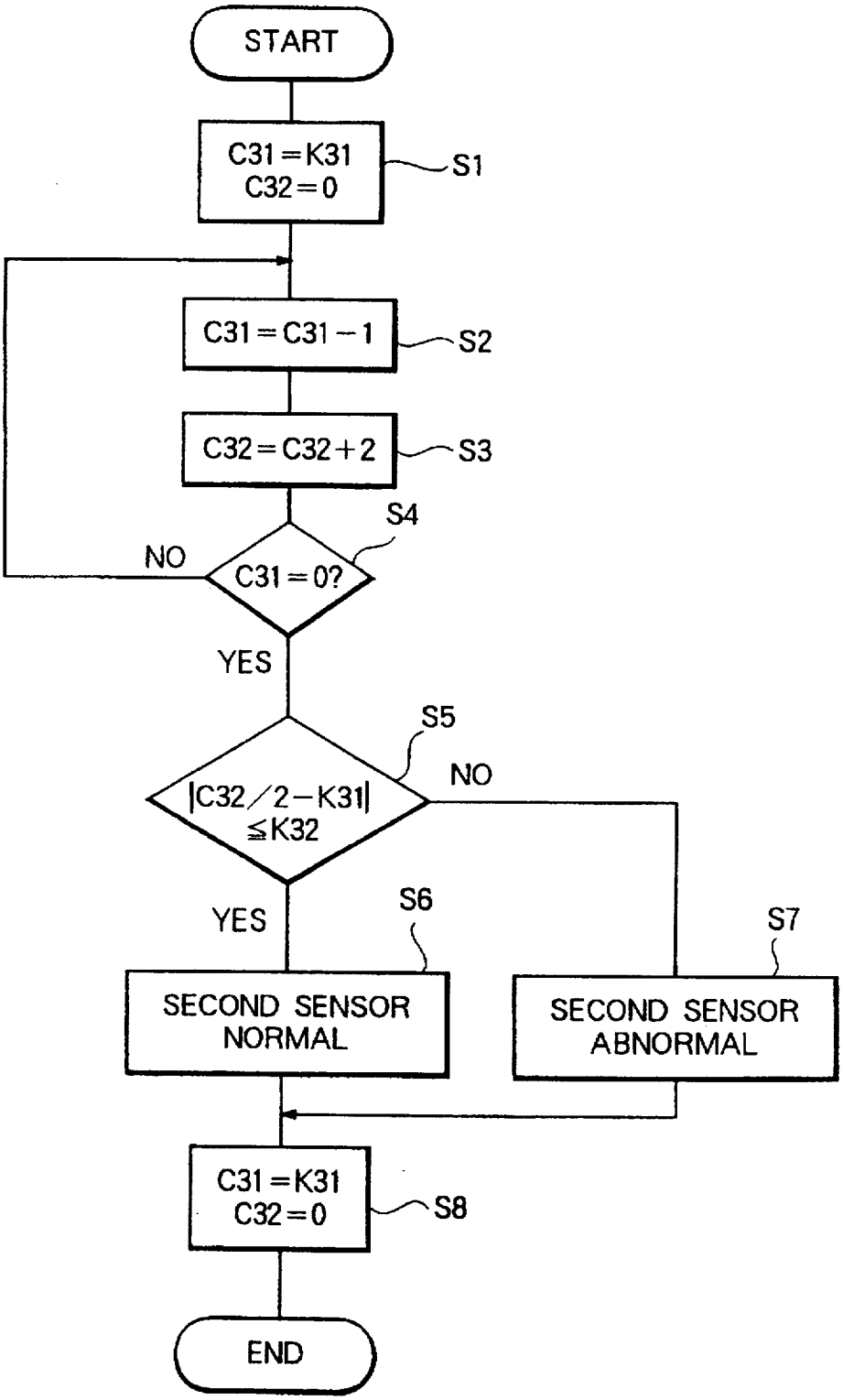
FIG. 3 is a flowchart explaining operation of the first embodiment.

Next, operation of the first embodiment of the invention shown in FIG. 1 will be described with reference to FIG. 3 using a case for determining the failure of the crank angle sensor 5 as the second sensor as an example.

First, when electric power is supplied to the controller 7, a predetermined value K31 is set as a count value C31 of the counter 73 at step S1, and 0 is set as a count value C32 of the counter 74. The predetermined value K31 may be any arbitrary value and set to, for example, 8 (corresponding to two cycles of the engine).

Next, 1 is subtracted from 8 or the count value C31 of the counter 73 at each rising-up edge of an output signal output from the rotational speed sensor 4 as the first sensor shown in FIG. 2 at (*b*) at step S2. In addition, 1 is added to the count value C32 of the counter 74 at each falling-down edge of an output signal from the crank angle sensor 5 as the second sensor shown in FIG. 2 at (*c*) at step S3.

As apparent from FIG. 2, since the output signal from the crank angle sensor 5 is twice that of the rotational speed sensor 4 in frequency, the count-up executed by the counter 74 is executed at a speed twice that of the count-down executed by the counter 73. Therefore, when the count value C31 of the counter 73 is 0, the count value C32 of the counter 74 is 16.

Next, at step S4, it is determined whether or not the count value C31 of the counter 73 is 0 or not, and unless C31=0, that is, when the count value C31 is not counted down 8, the process returns to step S2 and repeats the above operation, whereas when C31=0, the process goes to step S5.

At step S5, it is determined whether or not the absolute value of $|(C32/2)-K31)|$ is equal to or less than a predetermined value K32. Here, the predetermined value K32 is set to a suitable value, taking into consideration the shift of interruption processing executed by the counters 73 and 74 which is caused by the shift of the rising-up of the pulse of the output signal from the rotational speed sensor 4 or the shift of the falling-down of the pulse of the output signal from the crank angle sensor 5 in one cycle of the engine.

More specifically, when the engine has four cylinders, the rotational speed sensor 4 generates four pulses and the crank angle sensor 5 generates eight pulses which are twice those of the rotational speed sensor 4 in one cycle of the engine, as shown in FIG. 2. Thus, the predetermined value K32 is set to 5 which corresponds, for example, to a value obtained by adding one pulse to the four pulses of the rotational speed sensor 4 taking the above shift of the interruption processing into consideration.

When the absolute value of $|(C32/2)-K31)|$ is equal to or less than the predetermined value K32 at step S5, it is determined that the crank angle sensor 5 as the second sensor is normally operated.

That is, when the crank angle sensor 5 is normally operated, the counter 73 is counted down 1 whereas the counter 74 is counted up 2. Therefore, at the time when the count value of the counter 73 is counted down from 8 to 0 at step S5, the count value C32 of the counter 74 is counted up to 16, thus $|16/2-8| \leqq 5$ is established. Thus, it is found that the crank angle sensor 5 is normally operated.

On the other hand, when the absolute value of $((C32/2)-K31)$ is greater than the predetermined value K32 at step S5, it is determined that the crank angle sensor 5 is abnormally operated and thus fails.

That is, when the crank angle sensor 5 fails and the counter 74 counts nothing and thus the count value C32 thereof is made to 0, $|(0/2)-8|5$ is not established as a result of the determination at step S5. Therefore, it is found that the crank angle sensor 5 is in abnormal operation (fails).

However, when it is supposed that only 15 pulses, for example, are counted due to the shift and the like of the interruption processing regardless of the fact that the output signal from the crank angle sensor 5 intrinsically has 16 pulses in the above hypothetic condition, the crank angle sensor 5 is generally determined abnormal although it is actually normally operated. Since the crank angle sensor 5 is not abnormally operated (does not fail) in such a case, however, $|(15/2)-8| \leqq 5$ is established, thus the determination that the crank angle sensor 5 is abnormal is ignored.

After the processings executed at step S6 or step S7, the predetermined value K31 is set as the count value C31 of the counter 73 and 0 is set to the count value C32 of the counter 74 to thereby complete the processing operation.

As-described above, even if the crank angle sensor as the second sensor which is used as a sensor for detecting the rotational variation of the internal combustion engine for detecting misfire or the like fails due to breaking of wire or the like, the failure of the sensor is securely detected and promptly coped with by repairing or the like in the embodiment. Consequently, fuel can be very reliably controlled by preventing the erroneous determination of the detection of misfire and the malfunction of the internal combustion engine.

Figure 4:
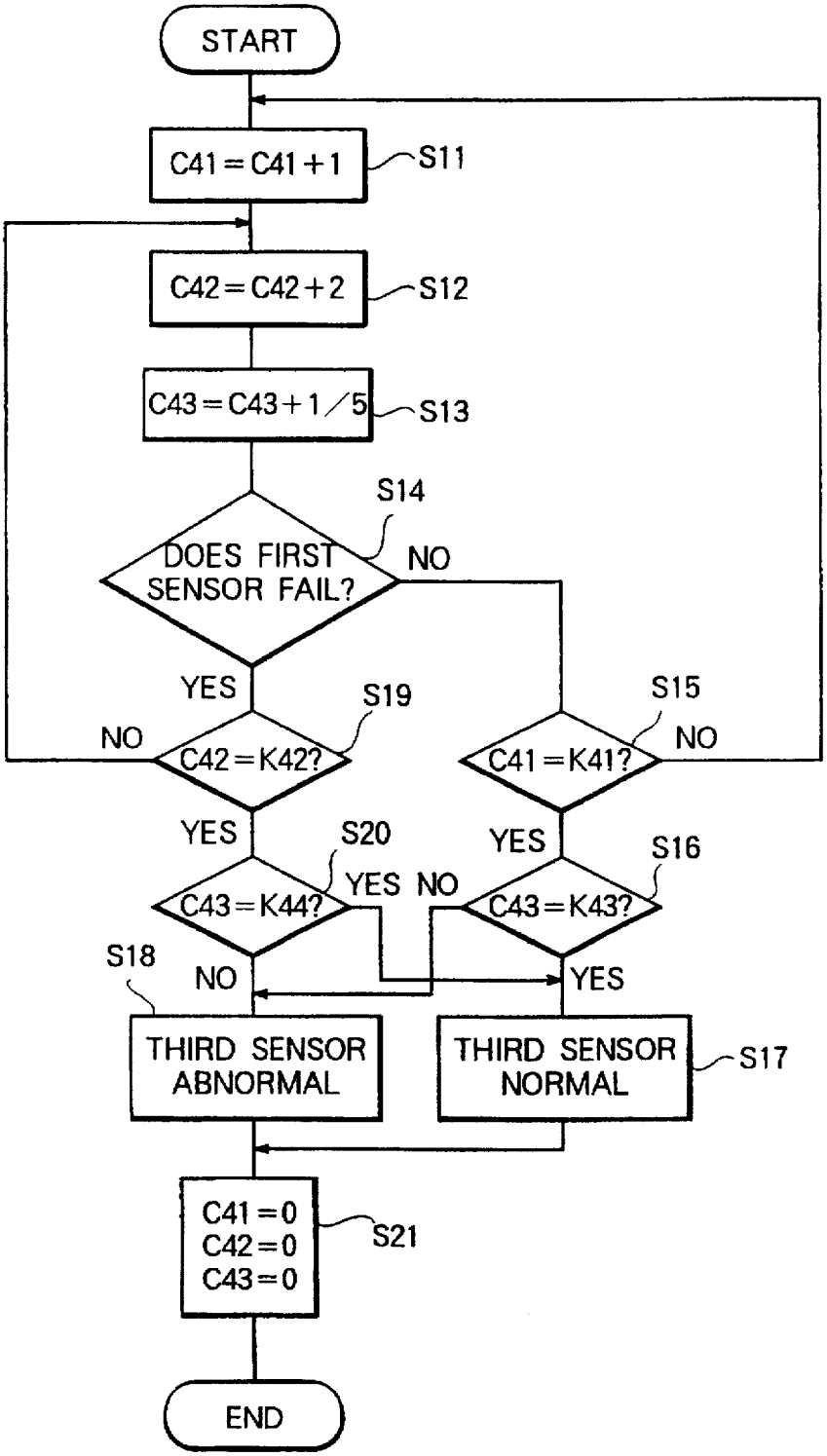
FIG. 4 is a flowchart explaining operation of a second embodiment of the fuel controller.

FIG. 4 is a flowchart showing a second embodiment of the present invention.

Although a rotational speed sensor 4 as a first sensor is usually used to determine, for example, the failure of the cylinder discrimination sensor 6 as the third sensor in the second embodiment, when the rotational speed sensor 4 fails, the second embodiment determines the failure of the cylinder discrimination sensor 6 using the crank angle sensor 5 as a second sensor in place of the rotational speed sensor 4. Since a circuit arrangement of the second embodiment is substantially the same as that of FIG. 1 except that the content of a program stored in a ROM 76 is different from that of the program stored in the ROM 76 of FIG. 1 and a processing executed by a CPU 71 is different from that in FIG. 1 accordingly, thus the description of the circuit arrangement of the second embodiment is omitted.

Next, operation of the second embodiment will be described with reference to FIG. 4.

First, after the contents of a counter 72, a counter 73 and a counter 74 are cleared on the energization of a controller 7, 1 is added to a count value C41 of the counter 73 at each rising-up edge of a signal output from the rotational speed sensor 4 as a first sensor shown in FIG. 2 at (b) at step 11.

1 is added to a count value C42 of the counter 74 at each falling-down edge of an output signal output from the crank angle sensor 5 as the second sensor shown in FIG. 2 at (c) at step S12. Further, 1 is added to a count value C43 of the counter 72 at each rising-up edge of an output signal output from the cylinder discrimination sensor 6 as the third sensor shown in FIG. 2 at (a) at step S13.

Next, it is determined whether the rotational speed sensor 4 as the first sensor fails or not at step S14. The failure (breaking of wire) of the rotational speed sensor 4 is determined when, for example, a signal is not output from the rotational speed sensor 4 within a predetermined period of time at the start of the engine. When the rotational speed sensor 4 does not fail, the process goes to step S15, whereas when it fails, the process goes to step 19 to be described later.

It is determined whether the count value C41 of the counter 73 is a predetermined value K41 or not at step S15. As apparent from, for example, FIG. 2, the predetermined value K41 is set to 5 here as an example because at least 5 pulses are needed as the number of pulses of the output signal from the rotational speed sensor 4 to find the rising up of an output signal output from the cylinder discrimination sensor 6.

Unless C41=K41 at step S15, since the count value C41 of the counter 73 cannot find the rising-up of the output signal output from the cylinder discrimination sensor 6 at the number of pulse less than a fifth pulse counted from a first pulse of the output signal output from the rotational speed sensor 4, the process returns to step S11 and repeats the above operation. On the other hand, when C41=K41, since the count value C41 of the counter 73 can find the rising-up of the output signal output from the cylinder discrimination sensor 6 at the number of pulse equal to or greater than a fifth pulse counted from a first pulse of the output signal output from the rotational speed sensor 4, the process goes to step S16.

It is determined at step S16 whether the count value C43 of the counter 72 is equal to a predetermined value K43 or not. The predetermined value K43 is set to 1 here as an example since the rising-up of an output signal output from the cylinder discrimination sensor 6 exists at least once among the five pulses of the output signal output from the rotational speed sensor 4 as apparent from, for example, FIG. 2.

When C43=K43 at step S16, since the count value C43 of the counter 72 is 1 and the rising-up of the output signal output from the cylinder discrimination sensor 6 exists once among the 5 pulses of the output signal output from the rotational speed sensor 4, it is determined that the cylinder discrimination sensor 6 as the third sensor is normally operated (step S17). On the other hand, unless C43=K43, since the count value C43 of the counter 72 is 0 and no rising-up of the output signal output from the cylinder discrimination sensor 6 exists among the 5 pulses output from the output signal of the rotational speed sensor 4, it is determined that the cylinder discrimination sensor 6 is abnormally operated and fails at step S18. The processing operation executed at steps S14 to S18 is usual processing operation executed when the rotational speed sensor 4 is not failed by breaking of wire or the like.

It is determined at step S19 whether the count value C42 of the counter 74 is equal to a predetermined value K42 or not. The predetermined value K42 is set to 9 here as an example because at least 9 pulses are needed from an output signal output from the crank angle sensor 5 to find the rising-up of the output signal from the cylinder discrimination sensor 6 as apparent from, for example, FIG. 2.

Unless C42=K42 at step S19, since the count value C42 of the counter 74 cannot find the rising-up of the output signal output from the cylinder discrimination sensor 6 at the number of pulses less than a ninth pulse counted from a first pulse of the output signal output from the crank angle sensor 5, the process returns to step S12 and repeats the above operation. On the other hand, when C42=K42, since the count value C42 of the counter 74 can find the rising-up of the output signal output from the cylinder discrimination sensor 6 at the number of pulses equal to or greater than a ninth pulse counted from a first pulse of the output signal output from the crank angle sensor 5, the process goes to step S20.

It is determined at step S20 whether the count value C43 of the counter 72 is equal to a predetermined value K44 or not. The predetermined value K44 is set to 1 here as an example since the rising-up of the output signal output from the cylinder discrimination sensor 6 exists at least once among the 9 pulses of the output signal output from the crank angle sensor 5 as apparent from, for example, FIG. 2.

When C43=K44, since the count value C43 of the counter 72 is 1 and the rising-up of the output signal output from the cylinder discrimination sensor 6 exists once among the 9 pulses of the output signal output from the rotational speed sensor 4, it is determined that the cylinder discrimination sensor 6 as the third sensor is normally operated (step S17). On the other hand, unless C43=K44, since the count value C43 of the counter 72 is 0 and no rising-up of the output signal from the cylinder discrimination sensor 6 exists among the 9 pulses of the output signal output from the crank angle sensor 5, it is determined that the cylinder discrimination sensor 6 is abnormally operated and fails (step S18).

After the processing executed at step S17 or step S18, the count value C41 of the counter 73, the count value C42 of the counter 74 and the count value C43 of the counter 72 are set to 0 to thereby complete the processing operation.

In the second embodiment, even if the rotational speed sensor as the first sensor used to determine the failure of the cylinder discrimination sensor as the third sensor fails, the failure of the cylinder discrimination sensor can be determined using the crank angle sensor as the second sensor in place of the failed sensor, the failure can be securely and promptly coped with and fuel Embodiment 3

Figure 5:
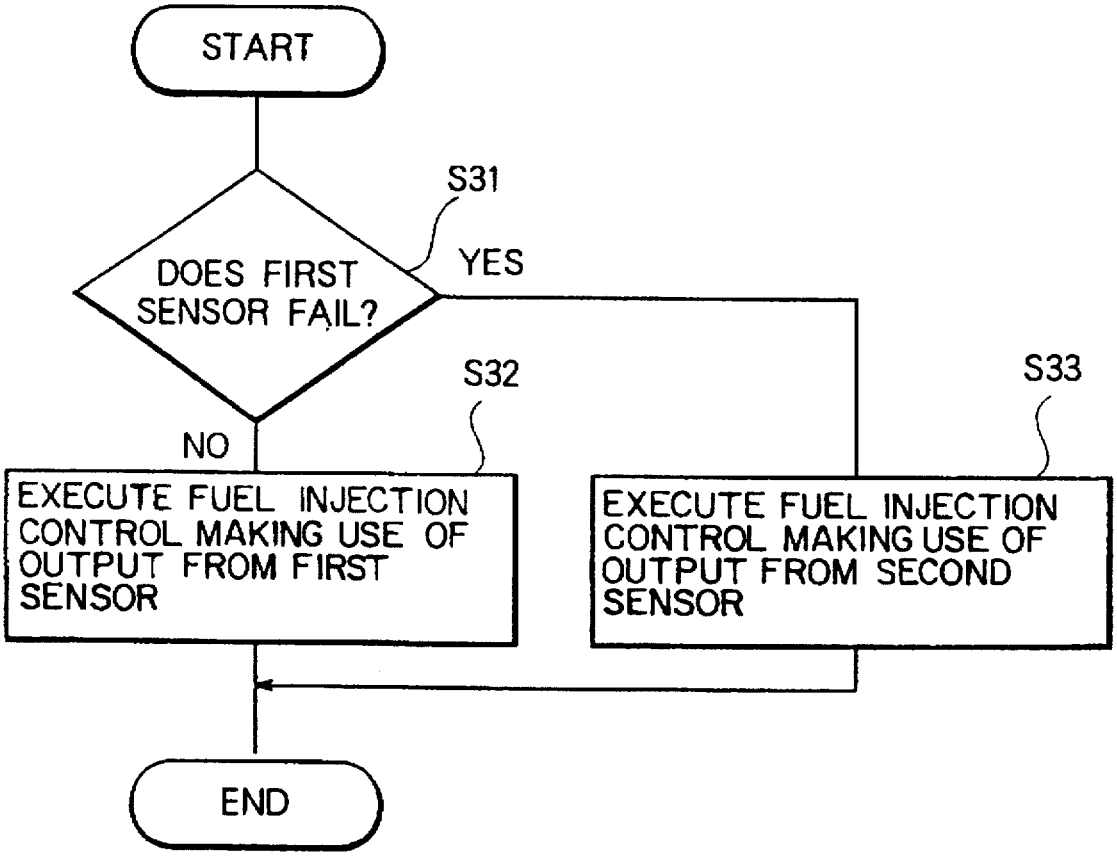
FIG. 5 is a flowchart explaining operation of a third embodiment of the fuel controller.

FIG. 5 is a flowchart showing a third embodiment of the present invention.

In the third embodiment, when a rotational speed sensor which is usually used to control fuel injection in the internal combustion engine is failed by, for example, breaking of wire, a crank angle sensor 5 as a second sensor is used in place of the rotational speed sensor. Since a circuit arrangement of the third embodiment is substantially the same as that of FIG. 1 except that the content of a program stored in a ROM 76 is different from that of the program stored in the ROM 76 of FIG. 1 and a processing executed by a CPU 71 is different from that in FIG. 1 accordingly, thus the description of the circuit arrangement is omitted.

Next, operation of the third embodiment will be described with reference to FIG. 5.

First, it is determined at step S31 whether or not the rotational speed sensor 4 as a first sensor is failed due to, for example, breaking of wire, and when the wire of the rotational speed sensor 4 is not broken, fuel injection is controlled making use of an output from the rotational speed sensor 4 at step S32. This routine is fuel injection control executed usually.

On the other hand, when the wire of the rotational speed sensor 4 is broken at step S31, fuel control is executed making use of an output from the crank angle sensor 5 as the second sensor.

According to the third embodiment, even if the rotational speed sensor as the first sensor used to control fuel injection fails, since fuel injection can be controlled using the crank angle sensor as the second sensor in place of the failed sensor, fuel control can be very reliably executed and thus vehicle control can be securely maintained.

What is claimed is:

1. A fuel controller for an internal combustion engine, comprising:

a first sensor for detecting a rotational speed of a cam shaft of an internal combustion engine;

a second sensor for detecting a rotational speed of a crank shaft of said internal combustion engine; and determination means connected to said first and second sensors for determining whether said second sensor is normally operated or not based on an output from said first sensor and an output from said second sensor, wherein said determination means includes a plurality of counters for counting output pulses output from said first and second sensors, and determines whether said second sensor is normally operated or not based on count values counted by said counters.

2. A fuel controller for an internal combustion engine according to claim 1, wherein when said first sensor fails, fuel is controlled based on an output from said second sensor.

3. A fuel controller for an internal combustion engine, comprising:

a first sensor for detecting a rotational speed of a cam shaft of an internal combustion engine;

a second sensor for detecting a rotational speed of a crank shaft of said internal combustion engine;

a third sensor for discriminating cylinders of said internal combustion engine; and determination means connected to said first, second and third sensors for determining whether said third sensor is normally operated or not based on an output from said second sensor when said first sensor fails.

4. A fuel controller for an internal combustion engine according to claim 3, wherein said determination means includes a plurality of counters for counting output pulses output from said first, second and third sensors, and determines whether said third sensor is normally operated or not based on count values counted by said counters.

5. A fuel controller for an internal combustion engine according to claim 3, wherein when said first sensor fails, fuel is controlled based on an output from said second sensor.

* * * * *